US009322538B2

(12) United States Patent
Peng

(10) Patent No.: US 9,322,538 B2
(45) Date of Patent: Apr. 26, 2016

(54) STRUCTURE OF LED LIGHT SET

(71) Applicant: Yau-Chin Peng, Hsinchu (TW)

(72) Inventor: Yau-Chin Peng, Hsinchu (TW)

( * ) Notice: Subject to any disclaimer, the term of this patent is extended or adjusted under 35 U.S.C. 154(b) by 0 days.

(21) Appl. No.: 14/594,176

(22) Filed: Jan. 12, 2015

(65) Prior Publication Data

US 2015/0123551 A1 May 7, 2015

Related U.S. Application Data

(63) Continuation-in-part of application No. 14/065,373, filed on Oct. 28, 2013, now abandoned.

(51) Int. Cl.

| | |
|---|---|
| ***H05B 41/295*** | (2006.01) |
| ***F21V 23/00*** | (2015.01) |
| ***H05B 33/08*** | (2006.01) |
| *H05B 41/28* | (2006.01) |

(52) U.S. Cl.

CPC ..... *F21V 23/002* (2013.01); *F21V 23/003* (2013.01); *H05B 33/0821* (2013.01); *H05B 33/0824* (2013.01); *H05B 41/28* (2013.01)

(58) Field of Classification Search

USPC ..... 315/185 S, 312–326, 291, 307

See application file for complete search history.

(56) References Cited

U.S. PATENT DOCUMENTS

| | | | | |
|---|---|---|---|---|
| 6,642,666 | B1 * | 11/2003 | St-Germain | 315/185 S |
| 7,045,965 | B2 * | 5/2006 | Li et al. | 315/185 S |
| 8,188,669 | B2 * | 5/2012 | Cheng | 315/185 R |
| 8,264,448 | B2 * | 9/2012 | Shteynberg et al. | 345/102 |
| 8,400,073 | B2 * | 3/2013 | Byun et al. | 315/291 |
| 8,643,282 | B2 * | 2/2014 | Huang et al. | 315/121 |
| 2002/0171365 | A1 * | 11/2002 | Morgan | F21V 33/004 315/56 |
| 2008/0315774 | A1 * | 12/2008 | May | F21K 9/54 315/152 |
| 2010/0066268 | A1 * | 3/2010 | Chang | 315/294 |
| 2010/0079091 | A1 * | 4/2010 | Deixler | H05B 37/0254 315/320 |
| 2010/0117691 | A1 * | 5/2010 | Lory | H04L 12/40019 327/141 |
| 2010/0244734 | A1 * | 9/2010 | Van Herpen | H05B 33/0803 315/294 |
| 2012/0086349 | A1 * | 4/2012 | Segan | H05B 33/0842 315/187 |
| 2013/0278156 | A1 * | 10/2013 | Hanyuda et al. | 315/186 |

* cited by examiner

*Primary Examiner* — Tuyet Vo
(74) *Attorney, Agent, or Firm* — Leong C. Lei

(57) ABSTRACT

An LED light set includes a controller connected with an electric plug and a main light string of a plurality of main light bulbs in serial arrangement. Each of the main light bulbs is connected with an associate light string of a plurality of associate light bulbs. A main control IC is provided in the controller to control voltage and current supplied to the main light bulbs of the main light string. An associate control IC is provided within each of the main light bulbs to control voltage and current supplied to the associate light bulbs of the associate light string. The voltage and current supplied to the associate light strings are controlled to be lower than those supplied to the main light string so that conducting wires of each of the associate light string can be made thinner than conducting wires of the main light string.

4 Claims, 2 Drawing Sheets

STRUCTURE OF LED LIGHT SET

CROSS-REFERENCE TO RELATED APPLICATION

This is a continuation-in-part of co-pending U.S. patent application Ser. No. 14/065,373 filed on Oct. 28, 2013 and owned by the present applicant.

BACKGROUND OF THE INVENTION (a) Technical Field of the Invention

The present invention is related to an LED (Light-Emitting Diode) light set, and particularly to an LED light set comprising an improved control and wiring structure.

(b) Description of the Prior Art

FIG. 1 is a schematic view depicting a conventional LED light set that includes a controller (10), which is provided with an electric plug (11) and a main control integrated circuit (IC) (12) and is connected with a main light string (20), which comprises main conducting wires (23) and a plurality of main light bulbs (21) connected in a serial arrangement. Each main light bulb (21) is individually connected with an associate light string (30), which is composed of associate conducting wires (32) and a plurality of associate light bulbs (31) connected in a serial arrangement, such that every associate light string is parallel to each other. The operation of the LED light set is as follows. After the electric plug (11) is connected to an electricity source, the light set is energized and the main control IC (12) contained in the controller (10) is the sole device that controls voltages, currents, and lighting modes of all LED light bulbs of both the main light string (20) and associate light strings (30). Both the main light string (20) and associate LED light strings (30) are operated at the same voltage and current and thus, the main conducting wires (23) and all associate conducting wires (32) are of the same gage. However, since the number of the associate conducting wires (32) used is huge so that the cost of the conducting wires is relatively high and consequently the manufacturing cost of the LED light set is also high. Such a known arrangement is generally impractical and further improvement is needed.

SUMMARY OF THE INVENTION

An object of the present invention is to provide, an improved LED light set, which comprises a main control IC arranged in a controller for controlling the operation of a main light string that comprises a plurality of main light bulbs, which are connected in a serial arrangement and are each connected to an associate light string comprising a plurality of associated light bulbs connected in a serial arrangement, and an associate control IC contained in each of the main light bulbs for controlling the operation of the associate light string connected thereto. The associate control IC contained in each of the main light bulbs is operable to control and adjust voltage and current that are applied to the associate light string connected thereto. The voltage and current applied to each the associate light strings can be of reduced levels as c compared to those of a primary power source supplied to the main control IC and the main light string. As such, each of the associate light strings may comprise associate conducting wires that are thinner than main conducting wires of the main light string so that the manufacturing cost of the light set can be reduced.

The foregoing provides only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings, identical reference numerals refer to identical or similar parts.

Many other advantages and features of the present invention will become manifest to those versed in the art upon making reference to the detailed description and the accompanying sheets of drawings in which an embodiment incorporating the principles of the present invention is shown by way of an illustrative example.

DETAILED DESCRIPTION OF THE PREFERRED EMBODIMENTS

The following description is an exemplary embodiment only and is not intended to limit the scope, applicability or configuration of the invention in any way. Rather, the following description provides a convenient illustration for implementing an exemplary embodiment of the invention. Various changes to the described embodiment may be made in the function and arrangement of the elements described without departing from the scope of the invention as set forth in the appended claims.

Figure 1:
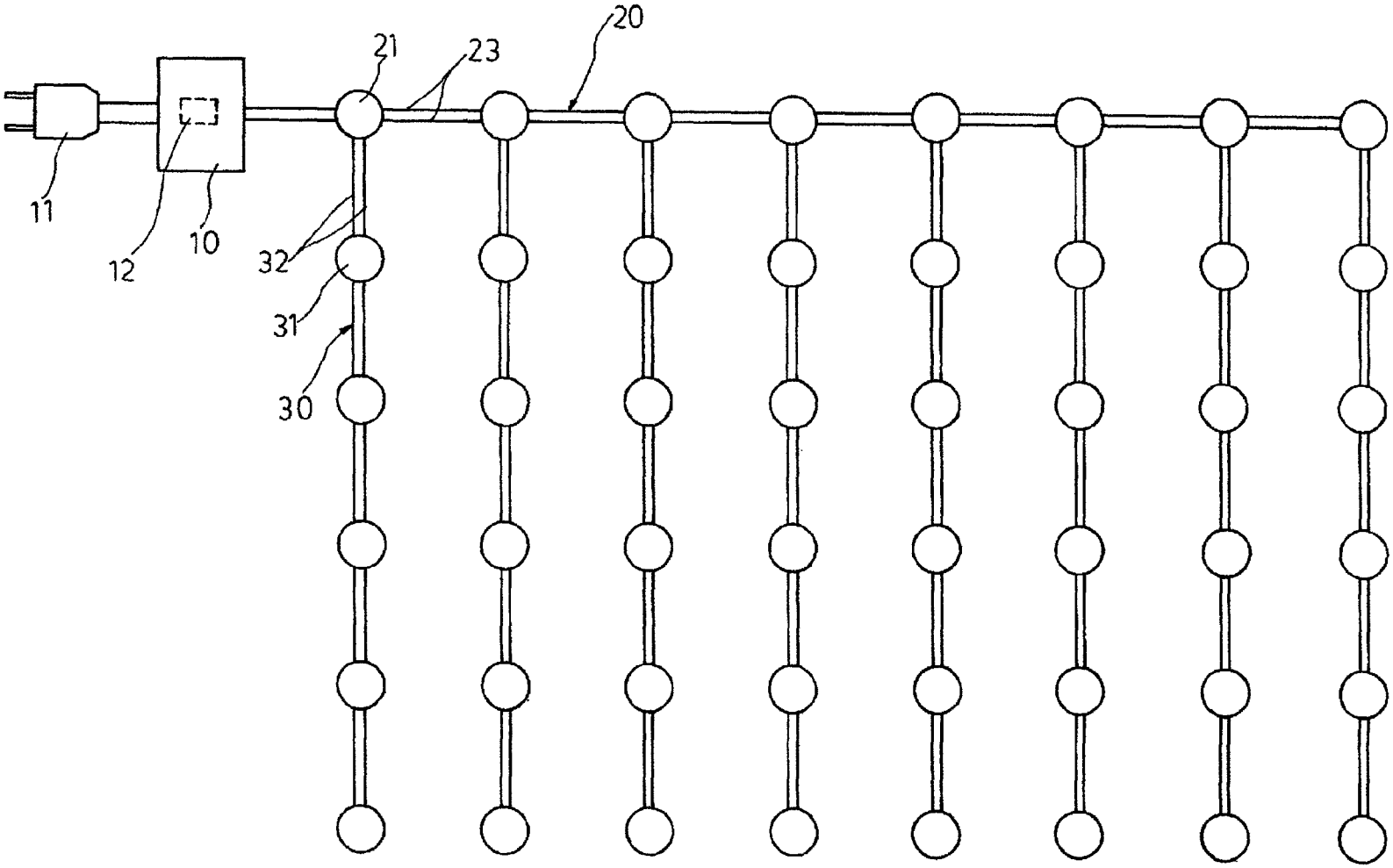
PRIOR ART FIG.1
FIG. 1 is a schematic view showing a conventional LED light set.
Figure 2:
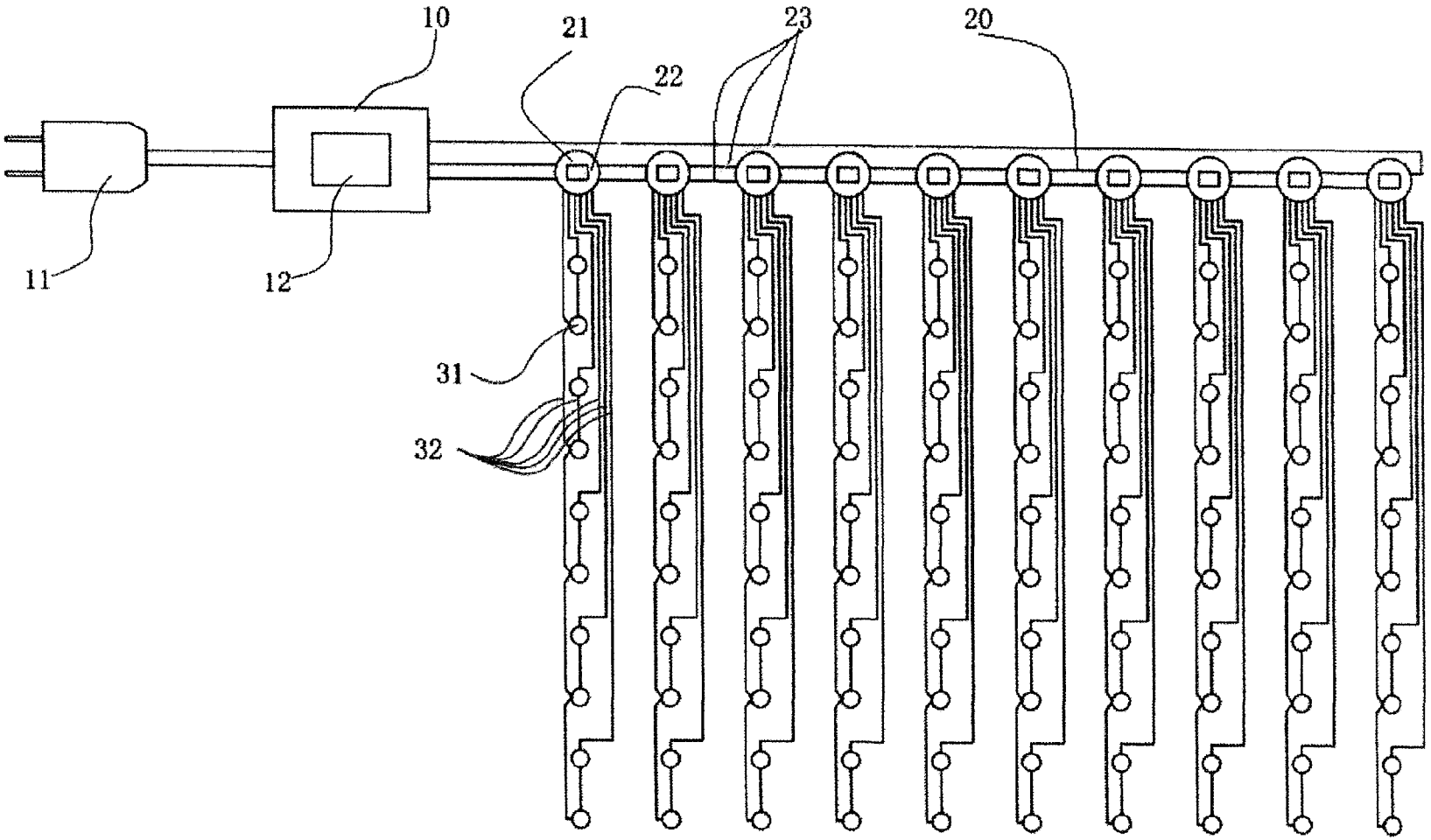
FIG. 2 is a schematic view showing an LED light set constructed in accordance with an embodiment of the present invention.

Referring to FIG. 2, a light-emitting diode (LED) light set constructed in accordance with an embodiment of the present invention generally comprises a controller (10), which is electrically connected between an electric plug (11) and a main LED light string (20). The main LED light string (20) comprises main conducting wires (23), which in the embodiment illustrated includes three wires of which two transmit electrical power, while the remaining one transmits a control signal, and a plurality of main light bulbs (21) connected to the main conducting wire (23) in a serial arrangement to receive electrical power therefrom for being energized to emit light. Each of the main light bulbs (21) is electrically connected with an associate light string, which is composed of associate conducting wires (32) and a plurality of associate light bulbs (31) connected to the associated conducting wires (32).

The LED light set of the present invention further comprises a main control IC (12) that is arranged within the controller (10) and associate control ICs (22) that are respectively arranged in the main light bulbs (21) of the main LED light string (20) and connected with the main conducting wires (23). The associate control IC (22) of each of the associate light strings is electrically connected to the associated conducting wires (32).

The controller (10) receives electrical power, via the electric plug (11), from a primary power supply (not shown) and the main control IC (12) arranged in the controller (10) receives the electrical power and supplies the electrical power to the main light bulbs (21) via the main conducting wires 23 in such a manner as to control electrical voltage, electrical current, and lighting mode applied to the main light bulbs (21). The main control IC (12) also supplies a control signal through the main conducting wires (23) to the associate control ICs (22).

Each of the associate control ICs (22) is connected to the main conducting wires (23) to receive electrical power and the control signal from the main control IC (12) and supplies the electrical power, in a controlled manner, to the associate light bulbs (31) of the associate light string through the associate conducting wires (32). The associate control IC (12) controls the electric voltage, electric current, and lighting mode applied to the associate light bulbs (31) of the associate light string in such a way that the associate control IC (22) adjusts both the voltage and current applied to the associate light bulbs (31) to reduce the voltage supplied to each associate light string to a level that is lower than the voltage supplied to the main LED light string (20). Therefore, the associate conducting wires (32) of the associate light strings (30) can be thinner than the main conducting wires (23).

As such, by using the associate control IC (22) contained in each of the main light bulbs (21) to adjust the voltage and current applied to the associate light string (30) connected thereto, the voltage and current can be lowered and thus the associate conducting wires (32) can be made thinner than the main conducting wires (23). Therefore, the manufacturing cost of the associate conducting wires (32) is significantly reduced due to the relatively large quantity of the associate light strings (30) and consequently the total manufacturing cost of the LED light set is also significantly reduced.

In addition, the associate light bulbs (32) of each of the associate light strings is arranged in a combined parallel and serial arrangement, where the associate light bulbs (32) are divided into groups, each of which comprises at least one light bulbs (two light bulbs being included in each group in the example illustrated in FIG. 2) and the light bulb groups are collectively connected in a parallel arrangement to the associate control IC (22) of the associate light string. In addition, for each of the light bulb group, the associate light bulbs (31) are connected in serial with each other. This arrangement helps further reduce the size of the associate conducting wires (32) used for the number of the associate light bulb (31) included in each light bulb group is less than the total number of the associate light bulbs (32) of the associate light string.

It will be understood that each of the elements described above, or two or more together may also find a useful application in other types of arrangement differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A light-emitting diode (LED) light set, comprising:

a controller, which comprises an electric plug adapted to connect to an external power supply to receive electrical power therefrom and a main control integrated circuit (IC) arranged in the controller and electrically connected to the electric plug;

a main light string, which comprises main conducting wires electrically connected to the main control IC to receive the electrical power and a plurality of main light bulbs connected to the main conducting wires in a serial arrangement, each of the main light bulbs comprising an associate control IC arranged therein and electrically connected to the main conducting wires; and associate light strings, which are respectively and electrically connected to the associated control ICs arranged in the main light bulbs, each of the associate light strings comprising associate conducting wires electrically connected to the respective associate control IC and a plurality of associate light bulbs connected to the associate conducting wires;

wherein the main control IC controls a first voltage and a first current and a first lighting mode applied to the main light bulbs of the main light string for selectively energizing the main light bulbs and each of the associate control ICs receives the first voltage and the first current and supplies a second voltage, a second current and a second lighting mode to the associate light bulbs of the associate light strings in such a way that the second voltage and second current supplied to the associate light strings are lower than the first voltage and first current supplied to the main light string and the associate conducting wires that transmit the second voltage and the second current are thinner than the main conducting wires that transmit the first voltage and first current, wherein the supply of the second voltage and second current by each of the associate control IC to the respective associate light string is determined by the enerization of the main light bulb to which the associate light string is connected; and wherein the main conducting wires comprise at least one wire that transmits a control signal from the main control IC to the associate control IC and at least one wire that transmits electrical power from the main control IC to the associate control ICs and the main light bulbs.

2. The LED light set according to claim 1, wherein the associate light bulbs of at least one of the associate light strings are divided into light bulb groups, which are connected in parallel to the associate control IC.

3. The LED light set according to claim 2, wherein at least one of the light bulb groups comprises a plurality of the associate light bulbs, which is connected in serial with each other.

4. The LED light set according to claim 2, wherein each of the light bulb groups comprises two of the associate light bulbs that are connected in serial.

* * * * *